US008547325B2

(12) United States Patent
Huitema

(10) Patent No.: US 8,547,325 B2
(45) Date of Patent: Oct. 1, 2013

(54) DRIVING METHOD AND SYSTEM FOR ELECTROFLUIDIC CHROMATOPHORE PIXEL DISPLAY

(75) Inventor: Hjalmar Edzer Ayco Huitema, Veldhoven (NL)

(73) Assignee: Creator Technology B.V., Breda (NL)

( * ) Notice: Subject to any disclaimer, the term of this patent is extended or adjusted under 35 U.S.C. 154(b) by 592 days.

(21) Appl. No.: 12/724,119

(22) Filed: Mar. 15, 2010

(65) Prior Publication Data

US 2011/0221726 A1 Sep. 15, 2011

(51) Int. Cl.
*G09G 3/34* (2006.01)

(52) U.S. Cl.
USPC ..... 345/107

(58) Field of Classification Search
USPC ..... 345/209, 212, 105–107; 359/290, 359/296
See application file for complete search history.

(56) References Cited

U.S. PATENT DOCUMENTS

| | | | | |
|---|---|---|---|---|
| 2003/0095091 | A1* | 5/2003 | Enomoto et al. | 345/87 |
| 2005/0212737 | A1* | 9/2005 | Yoshihara et al. | 345/87 |
| 2006/0077330 | A1* | 4/2006 | Ijzerman et al. | 349/143 |
| 2010/0208328 | A1* | 8/2010 | Heikenfeld et al. | 359/290 |

FOREIGN PATENT DOCUMENTS

| | | | |
|---|---|---|---|
| EP | 2 256 719 | A2 | 12/2010 |
| WO | WO 2004068208 | A1 | 8/2004 |
| WO | WO 2009/036272 | A1 | 3/2009 |
| WO | WO 2010/012831 | A1 | 2/2010 |
| WO | WO 2010/104392 | A1 | 9/2010 |

OTHER PUBLICATIONS

International Search Report for PCT/NL2011/050173 dated Jun. 22, 2011.

* cited by examiner

*Primary Examiner* — Chanh Nguyen
*Assistant Examiner* — Ram Mistry

(57) ABSTRACT

An electronic display is disclosed comprising a plurality of electrofluidic chromatophore (EFC) pixel cells. The display comprises a controller executing the steps of: storing the present cell display properties of the pixel cells displaying the present image content, comparing the present cell display properties with next cell display properties of the pixel cells, determining still-image pixels displaying still-image content wherein the present cell display properties of the pixels are substantially identical to the next cell display properties of the pixels, and providing a still-image drive scheme. The still-image drive scheme involves addressing a voltage to another one pixel cell terminal of the still-image pixels, the still image voltage being derived from the stable supply voltage that stabilizes the cell display properties of the still-image pixels so as to display still-image content in an energy efficient manner.

13 Claims, 7 Drawing Sheets

Figure 2
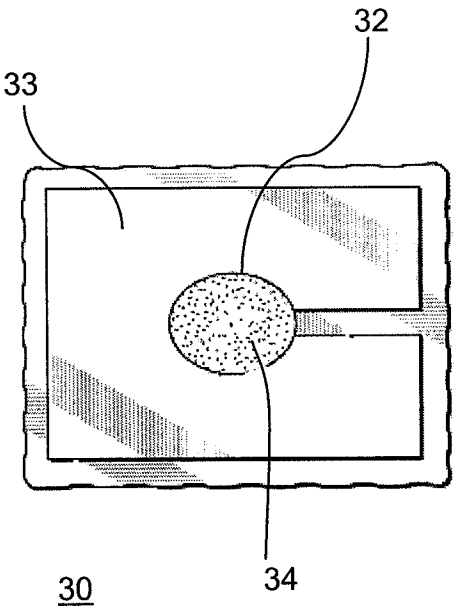
Figure 2B
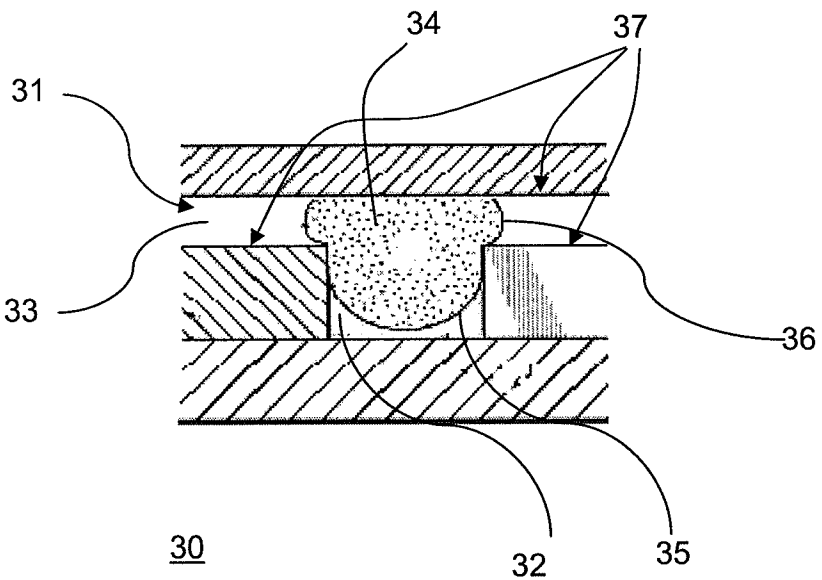
Figure 2A
(prior art)

Figure 5
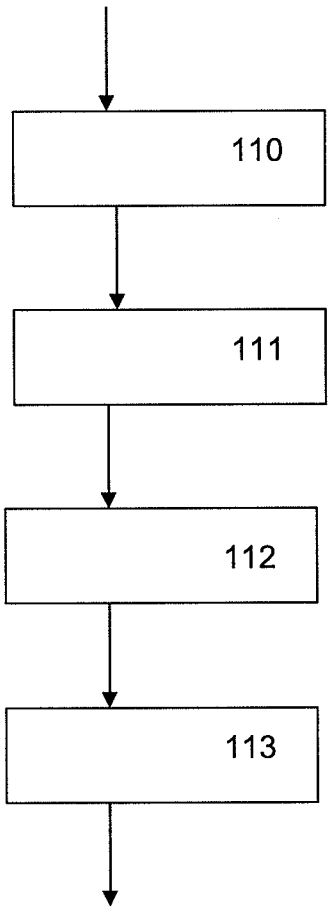
Figure 5B
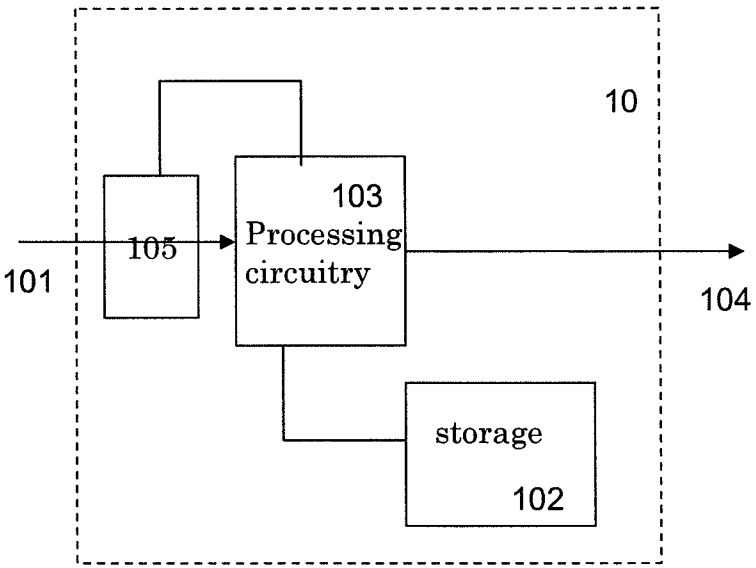
Figure 5A

Figure 6
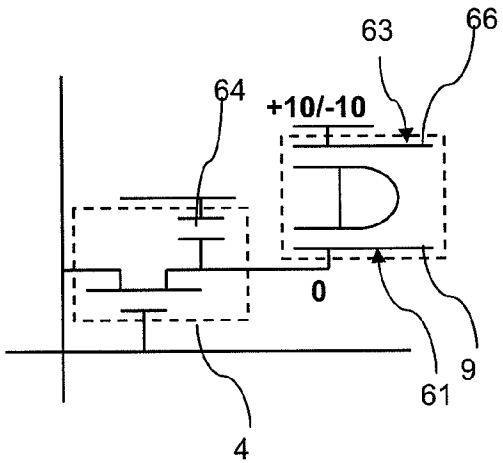
Figure 6A
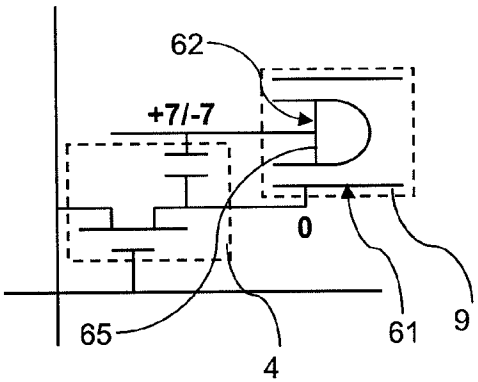
Figure 6B
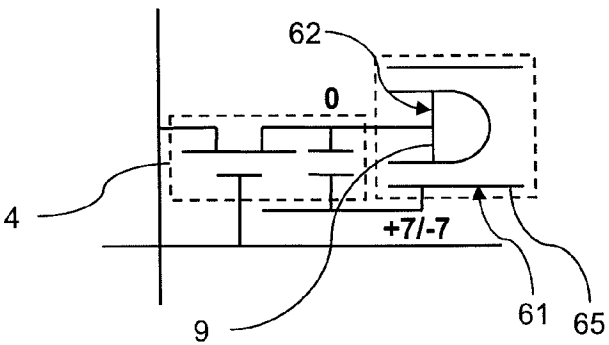
Figure 6C

Figure 7
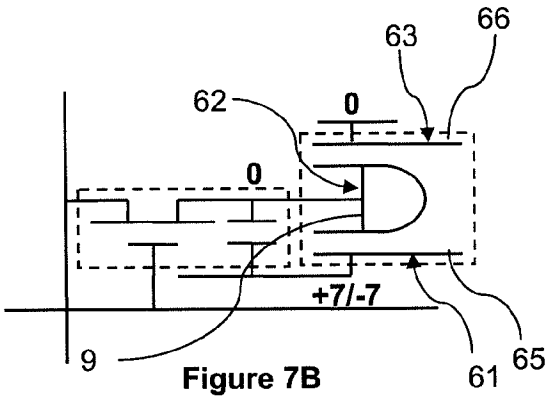
Figure 7B
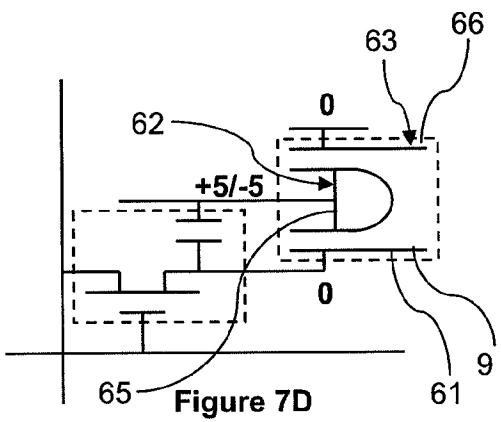
Figure 7D
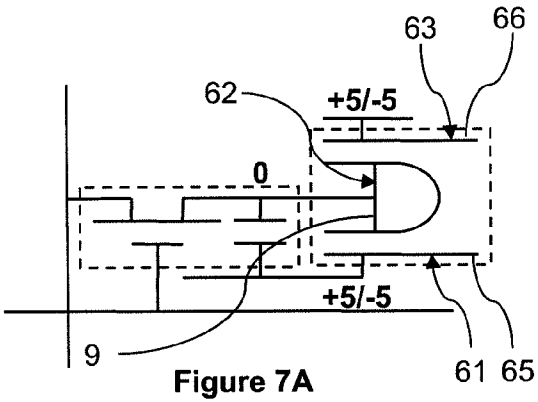
Figure 7A
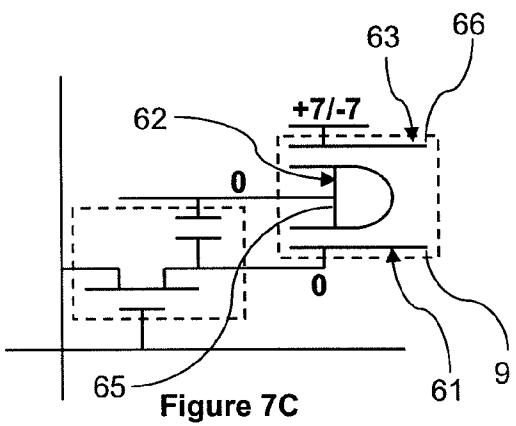
Figure 7C

DRIVING METHOD AND SYSTEM FOR ELECTROFLUIDIC CHROMATOPHORE PIXEL DISPLAY

TECHNOLOGY FIELD

The invention relates to the field of displays, in particular, displays comprising electrofluidic cells.

BACKGROUND OF THE INVENTION

Up to now, in certain areas of display technology, an electrophoretic electro-optical medium is commonly used, in particular for flexible displays. However, the electrophoretic electro-optical medium is subject to a number of restrictions. The medium has a relatively slow pixel response, which makes video display challenging, and has a relatively low brightness compared to paper.

Displays based on the electrowetting electro-optical medium may remedy at least some of the restrictions mentioned above. A particular variant using this principle is, for example, described in publication WO2004068208. This variant has a height dimension that is relatively large compared to liquid crystal or electrophoretic displays which hinders its use in flexible displays.

The recently developed Electrofluidic Chromatophore (EFC) variant of a display based on electrowetting has a smaller height dimension and may therefore be more suitable to use in flexible displays.

However, when the displayed content does not change, for example during e-reading static images, the EFC display typically needs to be kept in the charged state, in contrast to, for example, E-ink displays that keep their image even without charging the display. Furthermore it is desirable to change the polarity of the charges on the EFC display at regular time intervals to optimize the image quality during the lifetime of the display, which requires discharging and recharging of the display even when displaying static images. This poses a challenge to minimize power consumption—especially when used in battery powered mobile devices.

SUMMARY OF THE INVENTION

It is an object to provide an EFC display drive scheme to display content in an energy efficient manner.

According to an aspect of the invention, there is provided a display apparatus comprising a plurality of electrofluidic chromatophore (EFC) pixel cells. Each pixel cell comprises a fluid holder for holding a polar fluid and a non-polar fluid having differing display properties. The fluid holder comprises a reservoir with a geometry having a small visible area projected in the direction of a viewer onto the polar fluid, and a channel with a geometry having a large visible area projected in the direction of a viewer onto the polar fluid, the channel being connected to the reservoir so as to enable substantially free movement of the polar fluid and non-polar fluid between the channel and the reservoir. At least part of a surface of the channel comprises a wetting property responsive to a supply voltage over the pixel cell. The fluid holder further comprises at least two pixel cell terminals configured to provide the supply voltage to at least part of the surface of the channel comprising the wetting property. The display comprises a circuit board comprising: a switching circuit connected to a switched terminal of the pixel cell for supplying a switched voltage to the pixel cells, a row electrode connected to the switching circuit, a column electrode connected to the switching circuit, and a driver configured to provide drive signals charging the row and column electrodes to activate the switching circuits to address the switched voltage to the pixel cell.

The display further comprises a display controller for controlling the driver. The display controller executes the steps of determining still-image pixels displaying still-image content wherein the present cell display properties of the pixels remain substantially identical to the next cell display properties of the pixels, and provides still-image drive signals to the still-image pixels addressing a still image voltage to at least one pixel cell terminal other than the switched terminal of the still-image pixels, resulting in a stable supply voltage that stabilizes the cell display properties of the still-image pixels so as to display still-image content in an energy efficient manner.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

FIGS. 2A-B show an embodiment of an electrofluidic pixel cell suitable for use in association with the present invention;

FIGS. 5A-B: show an embodiment of a display controller (including steps performed by processing circuitry) in more detail;

FIGS. 6A-C: show exemplary embodiments having voltage inversion in two-terminal circuits; and FIGS. 7A-D: show exemplary embodiments having voltage inversion in three-terminal circuits.

DETAILED DESCRIPTION OF THE DRAWINGS

Figure 1:
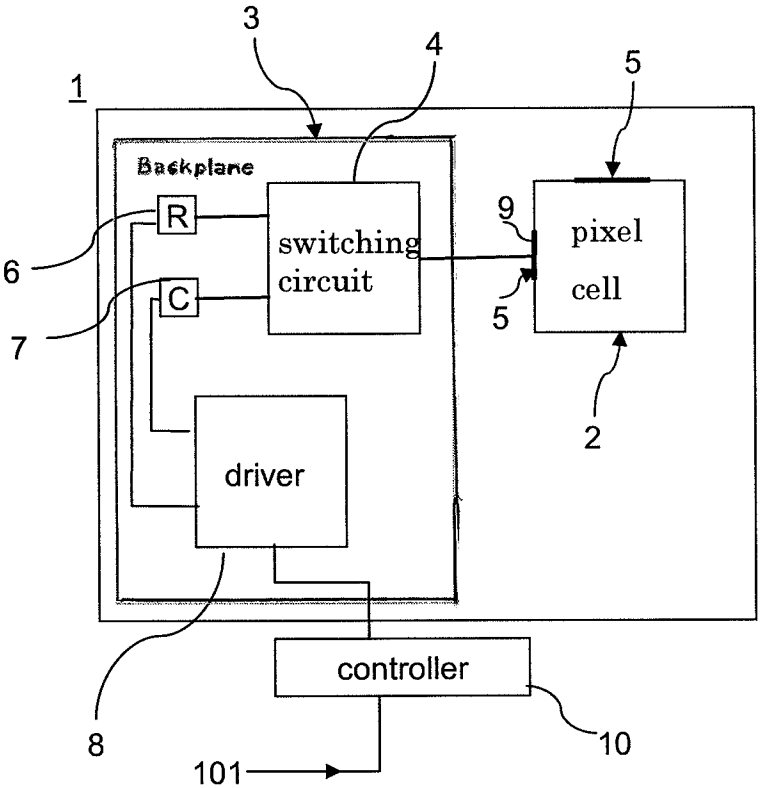
FIG. 1 shows an embodiment of the display apparatus of the present invention.

FIG. 1 shows an embodiment of the display apparatus 1 of the present invention. Besides a plurality of pixel cells 2, the display apparatus 1, as shown in FIG. 1, further comprises a flexible circuit board 3, known in the art, also referenced as a backplane and bendable with a small radius for example smaller than 2 cm—so that the display can be rolled, flexed or wrapped in a suitably arranged housing structure. The circuit board 3 comprises a plurality of switching circuits 4 for supplying an electrical charge to the pixel cells 2, where each switching circuit 4 is connected to one pixel cell 2 and vice versa. The switching circuit 4 is connected to at least one of the pixel cell terminals 5. The switching circuit 4 comprises an active element typically including a thin film (field effect) transistor. It is noted that the term switching circuit is a neutral term in the sense that it does not imply the character of the active element nor does it imply the drive schemes used to control the pixelized electrofluidic cells. The circuit board 3 further comprises a plurality of row electrodes 6 and column electrodes 7. The row and column electrodes are pairwise coupled to the switching circuits. It may however also be possible that more or less electrodes are connected to the switching circuit 4, depending on the specific implementation of the switching circuit 4.

A driver 8 is configured to charge the row 6 and column electrodes 7 and activate the switching circuits 4 to address the switched voltage to the pixel cells 2 via switched terminal 9. The driver 8 may be incorporated in the circuit board 3 or any other convenient place.

A display controller 10 is arranged to control the driver 8 as a result of pixel image information 101 inputted in the display controller 10.

In the following, the operation of the present EFC pixel cell is further explained. Amongst others, it will be shown that there is a stable supply voltage that stabilizes the fluid in a pixel cell, independent of the display properties of that pixel cell.

FIGS. 2A-B shows an embodiment of the pixel cell 2 in more detail. This embodiment of the pixel cell 30 comprises a fluid holder 31. The fluid holder 31 comprises a fluid reservoir 32 with a small visible area projected in the direction of a viewer and a channel 33 with a large visible area projected in the direction of a viewer. The reservoir 32 and the channel 33 are connected so as to enable free movement of the polar fluid 34 between the channel 33 and the reservoir 32.

Typically, besides a polar fluid 34, the fluid holder 31 also comprises a non-polar fluid (not shown). To generate a cell display property, the polar fluid 34 and the non-polar fluid have differing display properties. A display property may, for example, be a color, also encompassing monochromatic variants or a certain transmission and/or reflection characteristic of the fluid. In one embodiment, the polar fluid 34 has a transmission differing from the non-polar fluid. Typically, the polar fluid 34 comprises water and the non-polar fluid comprises oil. Preferably the water is blackened and the oil is left clear or is diffuse scattering, because blackening water with pigments may yield a more saturated black than blackening oil with dyes. Pigmented blackened water may result in a sufficiently black pixel color with a layer of water with a thickness of only 3 micrometer. This allows a display with a total thickness less than 100 micrometer, which typically is within a suitable thickness range for flexible displays. Typically the water contains ionic content as the conductive element. The non-polar fluid may occupy the space not occupied by the polar fluid 34. The non-polar fluid is preferably immiscible with the polar fluid 34.

In an embodiment, the geometry of the channel 33 and the reservoir 32 are carefully constructed to impart a mutually differing principle radius of curvature. In such embodiments, the fluid reservoir 32 imparts a large principle radius 35 of curvature onto the polar fluid and the channel imparts a small principle radius 36 of curvature onto the polar fluid 34 when the surfaces of the channel 33 and the reservoir 32 are sufficiently hydrophobic. This configuration results in a Young-Laplace force that aims to bring the polar fluid in its energetically most favorable shape, i.e. the droplet shape and urges the polar fluid 34 into the reservoir 32.

On the other hand, however, the polar fluid 34 may be urged into the channel by generating an electromechanical force opposite to the Young-Laplace force. To control this force, at least part of a surface 37 of the channel 33 comprises a wetting property responsive to an applied supply voltage to the wall of the channel 33. The polar fluid 34 may comprise a conductive element or component. Typically a hydrophobic fluoropolymer is provided on at least part of the surface 37 of the channel 33, although other materials having a wetting property responsive to an electric field may be applied.

The electromechanical force is directed opposite to the counteracting force that urges the polar fluid 34 into the reservoir 32 and may be controlled by varying the supply voltage. This counteracting force may be the Young-Laplace force or another, oppositely directed, electromechanical force or a combination of those.

A supply voltage providing a balance of counteracting force and electromechanical force, i.e. a voltage whereby movement of the polar fluid 34 is absent, is called the stable voltage. Although the stable voltage may show variation depending on the cell display property, it is in principle unrelated to the cell display property. That is, substantially independent of the fluid front position, the stable voltage will stabilize the fluid front of the polar fluid 34. It is noted that this characteristic may not be found in other display types like electrophoretic or liquid crystal displays. In other words, providing the stable supply voltage to a pixel cell stabilizes the polar fluid 34 in cell 30.

By applying a supply voltage to at least a part of the channel surface 37 of the channel 33, the induced electric field typically reduces the hydrophobic character of the fluoropolymer and results in an electromechanical force, aiming to bring the polar fluid 34 from the reservoir 32 into the channel 33 that is proportional to the supply voltage over the at least part of the channel surface 37 squared. The supply voltage changes the wetting property of at least part of the surface 37 of the channel 33.

Varying the electromechanical force may be used to control the movement of the polar fluid 34 in the pixel cell 30. Therefore, the pixel cell 30 comprises at least two pixel cell terminals. The pixel cell terminals are arranged to apply a supply voltage to the at least part of the surface of the channel 33 comprising the wetting property responsive to an applied supply voltage. The supply voltage may be provided by a combination of voltage differences, from any of a number of electrodes attached to the pixel cell.

In FIG. 2B, it may be seen that the geometry of fluid reservoir 32 imparts a small visible area projected in the direction of a viewer onto the polar fluid 34 and the geometry of the channel 33 imparts a large visible area projected in the direction of a viewer onto the polar fluid 34. To create a black state, the blackened water occupies the channel 33 and the clear oil occupies reservoir 32. In the white state, the clear oil occupies the channel 33 and the blackened water occupies the reservoir 32. By varying the amount of black water and clear oil in the channel 33, various cell display properties, e.g. color states, may be created.

A color display variant may be implemented by using water of different colors for different pixel cells, for example red, green and blue or cyan, magenta and yellow, or by providing a color filter on top of a black and white display or by integrating the color filter in the display on or near the surface 37 of the channel 33.

Typically, the display 1 is refreshed a number of times per second. The frame time is defined as the time wherein all the pixels of a display are refreshed once. The frame time comprises a line selection time, wherein the active elements of all switching circuits 4 connected to one row 6 are activated, followed by a hold time, wherein the other rows are sequentially addressed.

During the line selection time the column electrodes 7 supply the switched voltage to the switched terminals of the switching circuits connected to the selected row. At the end of the line selection time, the switched voltage may be substantially equal to the column electrode voltage. This voltage may induce a certain movement of the polar fluid 34 in the channel 33 during the frame time. During the hold time all switching circuits connected to the row are deactivated. The charge supplied via the switching circuits to the switched terminal 9 during the line selection time is substantially retained on the switched terminal until the line selection time of the next frame.

Figure 3:
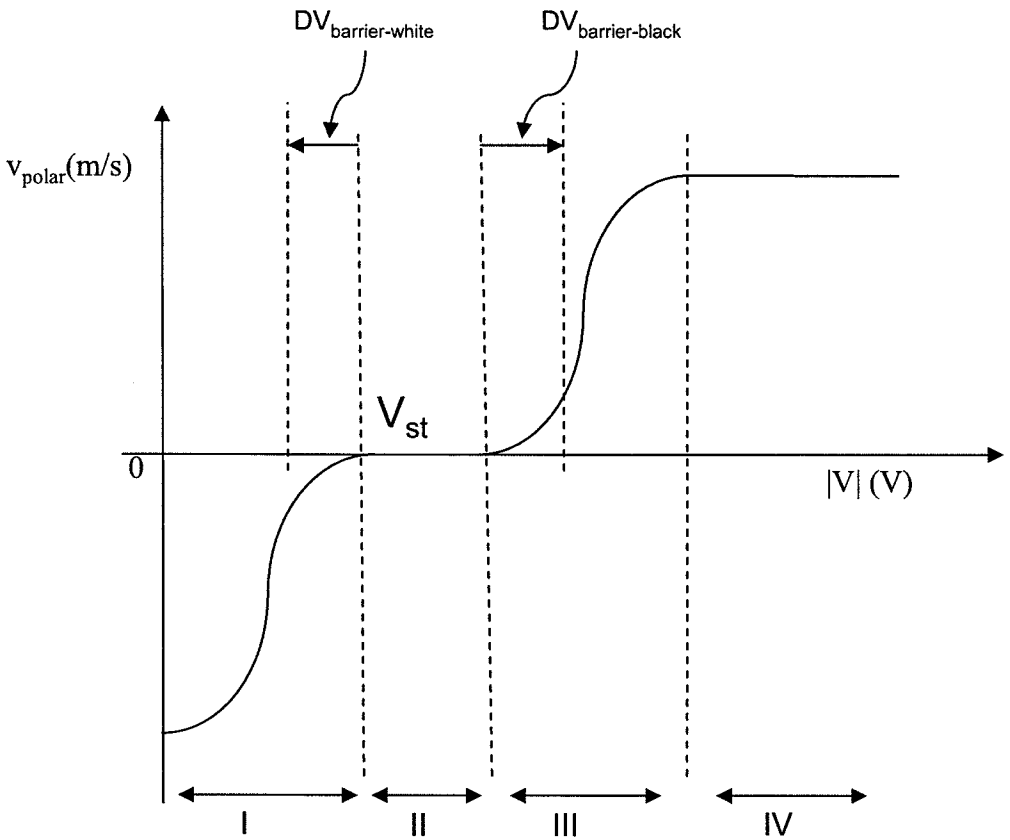
FIG. 3: shows, in an embodiment, a fluid front velocity depending on supply voltage.

FIG. 3 shows, in an embodiment, a fluid front velocity depending on supply voltage. In a schematic chart, the speed of the water vpolar, i.e. of the front of the polar fluid, also referred to as the water front, is depicted as a function of the supply voltage V over the channel surface. Thus, FIG. 3 illustrates the supply voltage regimes resulting in a movement of the polar fluid and a change of the cell display property. The x-axis represents the supply voltage over the channel surface; the y-axis represents the speed of the water front. Since the electromechanical force Fern is proportional to the voltage squared V^2, the graph is symmetrical around the y-axis, i.e. the system gives a substantially symmetrical response around 0V. Therefore the absolute value of the voltage is shown on the horizontal axis. In this graph, a positive speed means that the water moves into the channel and a negative speed means the water retracts out of the channel into the reservoir. The graph may be roughly divided in four parts.

In part I, from x=0, the speed starts at a negative value and steeply increases towards zero, the graph then reaches the x-axis. In part I, the counteracting force is larger than the electromechanical force so that the water retracts into reservoir.

In part II, the so-called stable region, the counteracting force is substantially equal to the electromechanical force and the speed equals zero so that the water front is stable at position. The supply voltage equals a stable voltage Vst when it is in stable voltage region II. The width of the region part II on the x-axis is non-zero due to the effects of wetting hysteresis or a wetting barrier that is inherent to the materials used in the pixel cell, or that is purposely added to the pixel cell to create a well-defined width for the region part II. The possible effect of wetting barriers on the stable region is indicated by the arrows labeled 'DVbarrier-white' and 'DVbarrier-black', indicating the effect of a barrier for the water front when retracting into the reservoir and when advancing into the channel, respectively. The effect of these barriers is to locally increase the width of the stable region to lower voltages and to higher voltages, respectively. Increasing the width of the stable region may make it possible to use a particularly energy efficient stable voltage in the still-image mode, as will further be explained in the below. These barriers may be provided by physical structures locally influencing an applied electric field to the channel surface having a wetting property, by physical structures locally influencing the wetting property or by physical structures locally influencing the radius of curvature and thus the Young-Laplace pressure of the polar liquid in the channel. These barriers may also include a change in the chemical composition at the surface which has strong influence on the wetting properties.

Subsequently, in part III, the electromechanical force becomes larger than the counteracting force; the speed of the water front is positive, which means that the water moves into the channel. In this part, the graph steeply rises until a plateau is reached.

The plateau is part IV wherein, although the voltage still increases and therewith the electromechanical force, the speed saturates and levels to a substantially constant value due to friction in the channel and/or due to the well known effect of contact angle saturation of the electrowetting effect.

The speed of the water front typically is in the order of centimeters per second and preferably between 0 and 50 centimeters per second, as 28 centimeters per second yields a switching speed between the black and the white state of about 1 millisecond for a pixel cell size of 0.2 millimeters (having a 0.28 millimeters diagonal size) when the reservoir is positioned in the corner of the pixel cell, which is compatible with displaying video content on the display apparatus. In this simple calculation, only the influence of the electromechanical force and the counteracting force have been taken into account. Other forces, such as the drag force that reduces the speed of the water front with the distance of the water front from the reservoir, have not been taken into account.

Depending on the channel geometry, the materials used, including the polar and non-polar fluid mixtures, the layer thicknesses and other specific geometrical and layout choices of the display apparatus and its pixels, the voltage in the stable part of the graph (part II) may be typically around 8V and the voltage at the onset of the water moving into the channel (start of part III) may be typically around 10V. The sum of the voltages squared, being proportional to the electromechanical force in the channel, is then 2×8^2=128V^2 for the stable condition and 2×10^2=200V^2 for the start of the water moving into the channel, where two equally sized bottom and top channel surface capacitors are assumed. These squared voltages are for relative use and reference only, and it is understood that similar parts I, II, and III could be achieved using only one surface capacitor or a variety of other liquid or capacitor arrangements.

Figure 4:
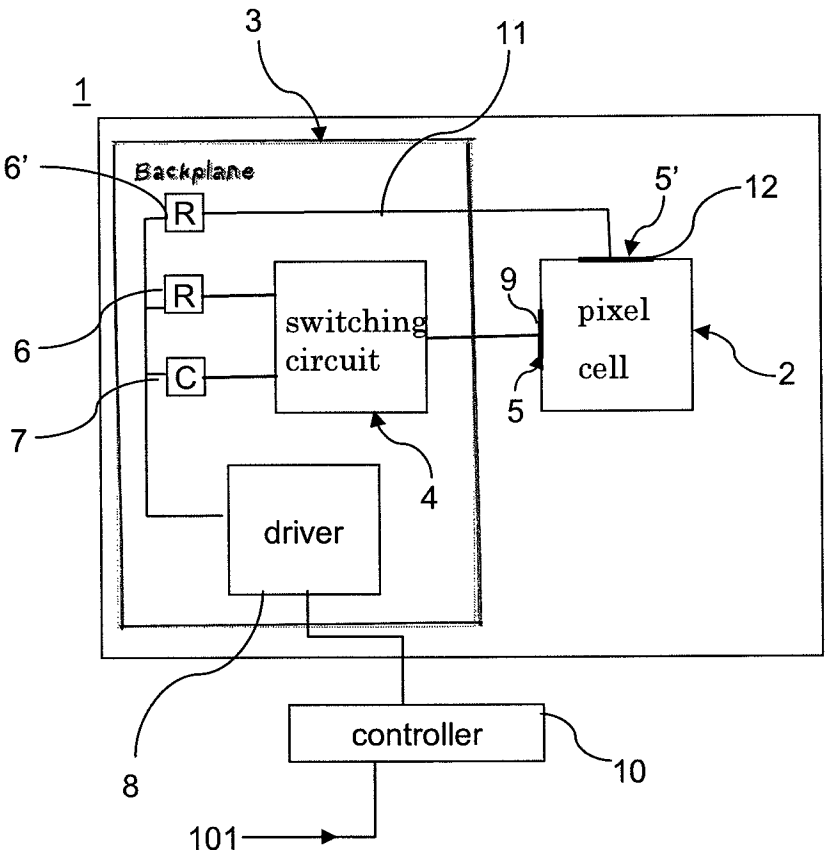
FIG. 4: shows an embodiment of the display apparatus of the invention comprising an additional direct voltage electrode.

FIG. 4 shows an illustrative embodiment of the display apparatus comprising an additional direct voltage electrode. In the embodiment a direct electrode 11 is coupled to pixel cell terminal 12. The apparatus is similar to the apparatus shown in FIG. 1, and therefore the same reference numbers are used. In this embodiment, the direct electrode is another row electrode 6', in addition to a row electrode 6 for providing a row select voltage to the switching circuit 4. The another row electrode (6') is directly coupled to the direct terminal 5' of the pixels in a row.

Typically, in an embodiment having a direct electrode, the pixel cell 2 comprises at least one further pixel cell terminal 5' that is coupled to a further electrode 11 to supply a direct voltage to the pixel cell. The driver is configured to additionally charge the further electrode 11 to define a pixel cell intermediate condition. This condition can be defined as a state of the pixel cell wherein the possible cell display property changes are limited due to the supply of a basic supply voltage to the at least one further pixel cell terminal with the aim to reduce the switched voltage required to induce a change in the cell display property. The direct voltage may be dependent on the display property change. The switching circuit typically has row and column electrodes 6, 7 respectively that connect the switching circuit to the driver, although it is also possible that more or less electrodes are used depending on the specific implementation of the switching circuit.

Power Consumption EFC

The power consumption of the present EFC display may be calculated with the following expression:

$$P=P_{rows}+P_{columns}+P_{st} \tag{1}$$

wherein P=total power consumption (excluding driver ICs and other electronics) and wherein Prows, the power consumption of the rows, may be calculated as:

$$P_{rows}=N_{rows}C_{row}(V_g^{off}-V_g^{on})^2 f \tag{2}$$

Nrows=number of rows

Crow=row capacitance

Vg=gate voltage/selection voltage f=frame rate

Pcolumns, the power consumption of the columns may be calculated as:

$$P_{column}=\tfrac{1}{2}N_{cols}(C_{column}+C_{px})(V_{data}^{max}-V_{data}^{min})^2 fN_{rows} \tag{3}$$

Ncols=number of columns

Ccolumn=column capacitance

Cpx=pixel capacitance

Vdata=data voltage f=frame rate

Nrows=number of rows

Pst, the power consumption of storage capacitor lines that are parallel to the rows and connect the storage capacitors of one row of pixels (see FIGS. 6 and 7) may be calculated as:

$$P_{st}=C_{st}(V_{st}^{max}-V_{st}^{min})^2 fN_{rows}N_{cols} \quad (4)$$

Cst=storage capacitance

Vst=direct voltage f=frame rate

Nrows=number of rows

Ncols=number of columns

From the equations, it becomes clear that low power driving options can be achieved in the following ways:

1. The number of times the voltage is changed on the column electrodes needs to be reduced (Nrows×Ncols is reduced).

2. The number of times the voltage is changed on the row electrodes needs to be reduced (less important as power consumption on the rows is much lower than on the columns) (Nrows is reduced).

3. Reduce the voltages used, as P=V^2×C (on the columns (most beneficial); on the rows).

4. Reduce the frequency of the update. When the complete image is in still image mode this is possible. (f is reduced).

5. Reduce the capacitance that needs to be charged.

Typically, the majority of the power is consumed by changing the data voltage Vdata, i.e. the voltage level on the column electrodes, as that is proportional to the number of pixels in the display, while the power consumed by the row and storage capacitor lines scales with the number of rows in the display.

FIGS. 5A-B show an embodiment of the display controller 10 in more detail, comprising storage 102 for storing the present cell display properties of the pixel cells displaying the present image content. The cell display property may be expressed as the transmission and/or reflection of the pixel cell at a predefined wavelength or in a range of predefined wavelengths; corresponding to a polar fluid front position in the channel.

The display controller 10 may be arranged to provide a still-image drive scheme applying signals by the driver to the still-image pixels, wherein, in the still-image drive scheme, a still image voltage is addressed to the at least one pixel cell terminal 5 other than the switched terminal 9 of the still-image pixels, resulting in a stable supply voltage that stabilizes the cell display properties of the still-image pixels, so as to display still-image content in an energy efficient manner.

The controller 10 further comprises processing circuitry 103 programmed to execute the steps of: storing 110 the present cell display properties of the pixel cells displaying the present image content, for each pixel comparing 111 the present cell display properties with next cell display properties of the pixel cells, determining 112 still-image pixels displaying still-image content wherein the present cell display properties of the pixels remain substantially identical to the next cell display properties of the pixels, and providing 113 a still-image drive scheme for the driver to apply to the still-image pixels as described above. It is noted, that the steps of storing 110 and comparing 111 may be directly carried out via the controller, but also different mechanisms to identify a still-image mode are feasible. For instance, the data stream may contain an identifier that identifies, for a subsequent number of frames, a still image or a group of still image pixels. In other embodiments, it is feasible that incremental image data, such as known from various compressing algorithms, may be used to determine the still-image pixels to be displayed during a still-image driving mode. Accordingly, to determine a still-image pixel, various approaches are possible.

Typically, the cell display property is expressed as the transmission and/or reflection of the pixel cell at a predefined wavelength or in a range of predefined wavelengths. The number of cell display properties is generally limited to a number of discrete levels within the complete range of possible transmission and/or reflection values. The pre-defined, discrete transmission and/or reflection values are measurable, physical values that can be represented by a (binary) number and as such can be processed by the controller.

In one embodiment of the display apparatus, the storing step 110 also involves storing the next cell display properties of the pixel cells.

The display controller 10 is arranged to calculate the electrical charge required to change the current pixel cell display property stored in the lookup table 102 to the new pixel cell display property and issues control signals 104 to control the driver 8 to supply the calculated electrical charge to the pixel cell.

The display controller is further arranged to change between a still-image display mode and a moving-image mode per pixel or group of pixels in the display. When in the still image mode, in an embodiment, the controller is programmed to execute the steps of; comparing the present cell display properties with next cell display properties of the pixel cells; determining pixels displaying still-image content wherein the present cell display properties of the pixels are substantially identical to the next cell display properties of the pixels, and providing a still-image drive scheme for the driver 8 to apply to the still-image pixels, wherein the still-image drive scheme involves addressing a direct voltage differing from the moving image voltage, to at least one pixel cell terminal 5 other than the switched terminal 9, that may result in a stable supply voltage that stabilizes the cell display properties of the still-image pixels. In the moving image drive scheme, the voltage on the direct terminals may be different than the voltage applied on the terminals during the still-image drive scheme. Substantially at the same time, a line selection period may be applied to all still-image rows of the display, such rows being rows that only contain pixels that are in the still-image mode, to set the switched voltage of the pixels that are in the still-image mode to a level that results in a stable supply voltage that stabilizes the cell display properties of those pixels. This can also be done row-at-a-time when the resulting supply voltage is still in the stable region after the direct voltage change. After this the row-at-a-time standard addressing can take place. Conversely, to obtain a still-image drive scheme for all pixels in the display, the voltage on the direct terminals is changed to the still-image voltage level and substantially at the same time a line selection period is applied to all rows of the display at the same time to set the switched voltage to the correct level for a stable condition. This can also be done in a row-at-a-time manner when the resulting supply voltage is still in the stable region after the direct voltage change. After this the still image mode driving can take place.

In one aspect, the display controller 10 provides a still-image display drive scheme to display still-image content in an energy efficient manner. Driving still-image content on a display different from the moving-image content for energy saving reasons may in some aspects be reminiscent to prior art techniques. In a bi-stable electrophoretic display, by way of example, the display needs only to be driven when the image content changes. When the image content does not change, no driving is necessary. However, when the displayed content does not change, for example during e-reading static images, the EFC typically needs charging, in contrast to for example E-ink displays. This poses a challenge to minimize power consumption especially when used in battery powered mobile devices.

An important characteristic of an EFC cell as described above with reference to FIG. 3, and particularly to part II of FIG. 3 is that the so-called stable voltage region comprises stable supply voltages that stabilizes the amount of polar fluid in the channel of a pixel cell and therefore leaves the display property unchanged, independent of the display properties of that pixel cell.

In one aspect, the display controller is arranged to provide a still-image drive scheme for the driver to apply to the still-image pixels, wherein the still-image drive scheme involves addressing a still image voltage to least one pixel cell terminal other than the switched terminal of the still-image pixels, resulting in a stable supply voltage that stabilizes the cell display properties of the still-image pixels, so as to display still-image content in an energy efficient manner.

One way to determine the still-image pixels involves the controller comprising processing circuitry 103 programmed to execute a number of steps. The controller stores 110 the present cell display properties of the pixel cells displaying the present image content and compares 111 for each pixel the present cell display properties with next cell display properties of the pixel cells. In practice, the next cell display properties may also be stored to be easily compared with the stored present display properties. The controller determines 112 still-image pixels displaying still-image content wherein the present cell display properties of the pixels are substantially identical to the next cell display properties of the pixels.

Addressing a still image voltage to at least one pixel cell terminal other than the switched terminal of the still-image pixels may allow the data voltage to be addressed to the switched terminal to be chosen in an energy efficient manner such that the data voltage in combination with the still-image voltage addressed to the at least one other pixel cell terminal other than the switched terminal generates a stable supply voltage and stabilizes the cell display properties of the still-image pixels.

In one embodiment of the display apparatus, the still image voltage addressing function is chosen such that a stable supply voltage is generated in the absence of switching the switched terminal. Displaying still-image content without switching a select voltage to the switched terminal is very energy efficient, since this prevents power losses due to switching.

In another embodiment of the display apparatus, the still image voltage addressing function is chosen such that a stable supply voltage is generated when addressing a data voltage resulting in a switched voltage of substantially zero Volts on the switched terminal. A switched voltage substantially equal to 0V is in general a low power voltage level for all other driving electronics, such as the column driver ICs. This results in an energy efficient still-image drive scheme.

As has been described above, the stable supply voltage is substantially independent of the display properties of the pixel cells and therefore the substantially same for all the still-image pixels. If the still image voltage addressed to the at least one pixel cell terminal other than the switched terminal is constant, the voltage applied to the column electrodes is also substantially constant.

In one embodiment of the display apparatus, a common terminal connected to a common electrode may be one of at least two pixel cell terminals. The still-image drive scheme involves charging the common electrode to address the voltage to the common terminals of the pixels in the display. In this embodiment, the common electrode addresses all the pixel cells simultaneously and may thus be applied when a still-image is displayed. An advantage of this embodiment may be that the supply voltage may be addressed with one common pulse to all the pixels in the display resulting in an extremely low power driving mode.

The still image voltage may also be addressed to the at least one pixel cell terminal other than the switched terminal of the still-image pixels row-at-a-time. The still-image drive scheme may be selectively applied only to those rows that display still-image content, while other rows are addressed with a moving-image drive scheme. The controller 10 typically comprises a mode switch 105 to switch between the moving-image drive scheme and the still-image drive scheme dependent on the image content. For example, the image content may be processed in a pre-processor, from which still-image data can be derived to adapt the controller. In addition, separate mode-switch signal may be provided from outside signal analysis circuits (not shown). To distinguish between moving image and still image drive schemes and accordingly adapt the driver control, a number of mechanisms may thus be provided.

In one embodiment of the display apparatus, the apparatus comprises at least one direct electrode and a direct terminal being electrically connected to the at least one direct electrode. The direct terminal may be the another one of at least two pixel cell terminals, that is, the direct electrode thus functioning as common electrode. In addition, the direct electrode may be a further electrode, in addition to the common electrode, directly connected to the direct terminal. The still-image drive scheme involves charging the at least one direct electrode to address the still image voltage to the direct terminal of the still-image pixel cell.

In another embodiment of the display apparatus, the still-image drive scheme involves simultaneously charging a plurality of direct electrodes to simultaneously address the still image voltage to the direct terminals of the pixels in a plurality of still-image rows. This may have the advantage that a plurality of still-image rows may be addressed with one pulse.

It is noted that when a display displays both moving-image and still-image content, the still-image drive scheme preferably provides a row non-select voltage similar to the non-select voltage of the moving-image drive scheme to prevent leakage between the column electrodes and the switched voltage of the pixels in the still image mode.

Further reduction of the power consumption of the display may be achieved by identifying still-image rows and by selecting all the still-image rows sequentially, row-at-a-time, and selecting moving-image rows later. This reduces the power consumption of the display as during selection of the still-image rows the column voltage is at a substantially constant level. In formula 3 regarding Pcolumn, this results in $$(V_{data}^{max}=V_{data}^{min})$$

and substantially no power consumption of the column electrodes is generated during selection of the still-image rows.

A further advantage of determining still-image rows may be that a reduced row select voltage may be used as the column voltage range is reduced to a substantially constant voltage level during addressing of the still image rows. This reduces the power consumption of the rows.

It is noted that care has to be taken when switching between the moving-image drive scheme and the still-image drive scheme to avoid creating image artifacts.

When switching from row-at-a-time addressing in the moving-image drive scheme to the still-image drive scheme, first all pixels to be addressed with the still-image drive scheme have to reach a stable state. Then the supply voltage on the direct terminals is changed to the still image voltage level and immediately after that—or substantially at the same time—a line selection period is applied to all rows of the display that contain the pixels to be addressed with the still-image drive scheme at the same time to set the switched voltage to the correct level for a stable condition. This may also be done row-at-a-time when the resulting supply voltage is still in the stable region after the direct voltage change. After this the still-image drive scheme driving may take place.

When switching from the still-image drive scheme to row-at-a-time addressing in the still-image drive scheme, first the voltage on the direct terminals is changed to the standard row-at-a-time voltage level for the still-image pixels now to be addressed with the moving-image drive scheme and immediately after that—or substantially at the same time—a line selection period is applied to all rows of the display that contain the still-image pixels now to be addressed with the moving-image drive scheme at the same time to set the switched voltage to back the correct level for a stable condition. This may also be done row-at-a-time when the resulting supply voltage is still in the stable region after the direct voltage change. After this the row-at-a-time standard addressing may take place.

In principle the still-image content may be maintained by applying a constant still image voltage to all terminals resulting in a stable supply voltage. A voltage polarity inversion may be applied as that may prevent charge build-up at the channel interfaces that may lead to image artifacts. The still image voltage polarity may be inverted on at least one pixel cell terminal 5 other than the switched terminal 9, while a DC voltage is addressed to the switched voltage terminal 9 of the still-image pixels.

In one embodiment of the display apparatus, the still-image drive scheme involves periodically changing the still image voltage to invert the polarity of the supply voltage, so as to obtain an average supply voltage being essentially zero with no directional build-up of charges in the pixel cells. To provide inversion in a still-image mode, the switched voltage terminal of the pixels that are in the semi bi-stable still image mode are preferably set to a constant, non-inverted voltage, while at least one of the other pixel cell terminals are inverted at regular intervals. It is preferred to have a switched voltage substantially equal to 0V for the pixels that are in the semi bi-stable still image mode as that is in general a low power voltage level for all other driving electronics, such as the column driver ICs.

FIGS. 6A-C show exemplary embodiments having voltage inversion in exemplary two-terminal circuits each having two pixel terminals. In FIG. 6A, switched terminal 9 is the bottom terminal 61 which is connected to a thin film transistor (TFT) switching circuit 4. Another one of the two pixel cell terminals is formed by top terminal 63, which is a common terminal 66 to be connected to a common electrode for a group of pixels or all pixels in the display. The switching circuit 4 may also comprise a storage capacitor 64.

The part of the channel occupied by water forms two capacitors in series between the top 63 and the bottom terminals 61 or—to be more precise—between the top and bottom electrodes (not shown). The rest of the channel forms one capacitor between the two electrodes where the oil forms part of the dielectric.

In FIG. 6B the switched terminal 9 is the bottom terminal 61 which is connected to a thin film transistor (TFT) switching circuit 4 with the same schematics as in FIG. 6A. Another one of the two pixel cell terminals is water terminal 62. The water terminal 62 is connected to a direct electrode 65. An advantage of this configuration may be that no top electrode is supplied resulting in simplified manufacturing of the display.

In FIG. 6C the switched terminal 9 is the water terminal 62 connected to a switching circuit 4 with the same schematics as in FIG. 6A. Another one of the two pixel cell terminals is bottom terminal 61 connected to a direct electrode 65. An advantage of this configuration may be that no top electrode is supplied resulting in simplified manufacturing of the display. The still image mode addressing is similar having direct terminal 61 and switched terminal 62 reversed relative to the FIG. 6B embodiment.

FIGS. 7A-D show exemplary embodiments having voltage inversion in a three-terminal circuit comprising two pixel terminals. In the embodiment shown in FIGS. 7A and 7B switched terminal 9 is the water terminal 62 connected to a switching circuit with the same schematics as in FIG. 6A. The direct terminal 65 is the bottom terminal 61 being electrically connected to a direct electrode. In this embodiment the top terminal 63 is a common terminal 66 connected to a common electrode for a group of pixels or all pixels in the display. Accordingly, in the FIG. 7A, 7B embodiments, the switched terminal 9 is coupled to a water terminal 62 contacting the conductive polar fluid and the direct voltage terminal 65 is coupled to a channel electrode.

In the embodiment shown in FIGS. 7C and 7D the switched terminal 9 is the bottom terminal 61 connected to a switching circuit with the same schematics as in FIG. 7A. The direct terminal 65 is the water terminal 62 being coupled to a direct electrode. The top terminal 63 is a common terminal 66 connected to a common electrode for a group of pixels or all pixels in the display. Accordingly, in the FIG. 7C, 7D embodiments the switched terminal 9 is coupled to a channel electrode 61 and the direct voltage terminal 65 is coupled to a contact electrode contacting the conductive polar fluid.

In the following, exemplary implementations for still image voltage inversion are described regarding the circuits shown in FIGS. 6 and 7. In these implementations it is assumed that the sum of the squared voltage difference over the channel surfaces is at least enough to keep a stable switching state of the pixel. In this example, the sum amounts to 49V^2. For energy saving reasons, the switched voltage is set to zero Volts.

The pixel configuration shown in FIG. 6A is periodically inverted over the common terminal 66 whereupon a voltage of +10/−10V is applied. Hence in FIG. 6A, a still image drive scheme for display may be provided by addressing a still image voltage to the common electrode 66. By patterning the common electrode in more than one segment, the display may be driven in still-image mode per segment. Here the other pixel terminal is thus the common electrode. In addition, still image pixels are addressed via the switched terminal 61 at a low voltage, preferably at 0V. Thus, the still image drive scheme may be carried out by actively driving the common electrode for all pixels in the display. This provides very low power as no voltage changes on the columns and also no voltage changes are needed per se on the rows.

The pixel in FIG. 6B is periodically inverted over the water terminal 62 connected to the direct electrode with a voltage of +7/−7V. The pixel in FIG. 6C is periodically inverted over the bottom terminal 61 connected to the direct electrode with a voltage of +7/−7V. Hence, in FIG. 6B a still image addressing mode can be carried out per row. Here, the pixel terminal 62 other than the switched terminal 61 for addressing a still image voltage is the water terminal 62, driven via a storage capacitor electrode (i.e. the direct terminal) for a row of pixels in the display. Still image pixels are addressed at a low switched voltage, preferably 0V. Here power consumption is reduced because the column voltage is a low power voltage. Even more power saving can be attained when rows in a still image mode are addressed simultaneously, since this reduces voltage changes. Most power saving occurs when all rows are in the still image mode.

The pixel configuration shown in FIG. 7A is inverted over both the bottom terminal 61 connected to the direct electrode and the common terminal 66. On both terminals a voltage of +5/−5V is applied. Preferably the common terminal 66 is driven by the inverse voltage of the bottom terminal 61, e.g. +5V on the common terminal when −5V is applied to the bottom terminal, and vice versa, as this results in minimum voltage changes on the switched terminal during inversion. However, asymmetric inversion on the two terminals is also possible (for example +/−6V and +/−3.75V) to further minimize voltage changes on the switched terminal or to minimize the power consumption based on the relative amount of capacitive load on the terminals. Hence, in FIG. 7A a still image mode is provided having still image pixels addressed at 0V via the switched terminal 62. As in FIG. 6A, by patterning the common electrode in more than one segment, the display may be driven in still-image mode per segment. The still image voltage is further provided by driving the common electrode 63 synchronized with the bottom terminal 61 (i.e. the direct terminal) for all pixels in the display. The still image mode is very low power as no voltage changes on the columns are needed, and also no voltage changes on the rows are needed.

In FIG. 7B, the same pixel configuration as shown in FIG. 7A is inverted over the bottom terminal 61 (i.e. the direct terminal 65) with a voltage of +7/−7V. In FIG. 7B, similar to FIG. 6B/C, a still image mode can be carried out per row. Still image pixels are addressed at a switched voltage of substantially 0V, while a still image voltage is provided is to the storage capacitor electrode (i.e. the direct terminal 65) for a row of pixels in the display. Because of a very low column voltage of substantially 0 Volt this is in general a low power arrangement. When rows in still image mode are addressed at the same time, additional power saving is possible. When all rows are in still image mode power saving is optimal.

The pixel configuration shown in FIG. 7C is inverted over the common terminal 66 whereupon a voltage of +7/−7V is applied. In FIG. 7C, the voltage over the water terminal 62 connected to a direct electrode is zero Volts. Accordingly, in FIG. 7C (similar to FIG. 6A en FIG. 7B) a still image mode for the display can be carried out by driving a still image voltage via common electrode (by patterning the common electrode in more than one segment, the display may be driven in still-image mode per segment). Still image pixels are addressed at substantially 0V. No voltage changes on the columns and rows are needed. This embodiment is particularly desirable due to the shielding of the switched voltage by the direct voltage terminal 62 during inversion of the voltage polarity on the common electrode. Effectively changing the voltage on the common electrode has no effect on the switched voltage, thereby minimizing potential issues with image artifacts due to the inversion.

In FIG. 7D, the same pixel configuration as shown in FIG. 7C is inverted over the water terminal 62 connected to a direct electrode with a voltage of +5/−5V. In FIG. 7D, the voltage over the common terminal 66 is zero Volts. Accordingly, in FIG. 7D (similar to FIG. 6B/C/7B) the still image mode can be carried out per row. Still image pixels are addressed at a switched voltage of 0V, and a still image voltage is provided via the storage capacitor electrode (i.e. the direct terminal 62) for a row of pixels in the display. The arrangement is lower in power as the reduced column voltage of substantially 0 Volt is in general a low power voltage. When rows in still image mode are addressed simultaneously, power saving is enhanced. Most power saving occurs when all rows are in a still image mode. Due to the reduced voltages on the direct terminal 62, this embodiment has very advantageous reduced power consumption.

Inversion may in principle be applied to individual pixels. However, for energy saving reasons it is preferred to simultaneously invert a group of pixels. In one embodiment, the inversion may be applied to the direct voltage electrode, e.g. a row electrode being coupled directly from driver 8 to direct terminals 65 of the pixels in a row.

An additional advantage of inverting the still-image content over another than the switched electrode may be that the stresses on the switching circuits are reduced as the voltages over the switching circuits are reduced. Reduced stresses may increase the lifetime of the display.

Simultaneously inverting a group of or all still-image rows may result in an extremely low power driving mode.

Common Inversion

Applying the inversion to the common electrode for a group of pixels or all pixels in the display being electrically connected to the common terminals 66 of the pixels may be especially advantageous. In this case, inversion is done with one common pulse to the inverted electrodes for a group of pixels or all pixels in the display.

Inversion may lead to a change of the switched voltage level due to capacitive coupling with one of the other pixel cell terminals during inversion (this is the case in all examples except the circuit shown in FIG. 7C). It is preferred to reset the switched voltage after each inversion to restore changes in the switched voltage due to capacitive coupling with one of the other pixel terminals during inversion. Therefore, the still-image drive scheme may involve periodically charging of the row and/or column electrodes being coupled to the switching circuit to reset the switched voltage.

Resetting the switched voltage may be done in a power saving manner. Resetting may, for example, be done in one line selection period common for a group of rows of pixels or all pixels that may have a longer length than the line selection period in the moving-image drive scheme. For example, when the line selection period is taken 4 times longer it may be possible to reduce the selection voltage level by a factor of 4 as the required average current to charge the switched voltage terminal is lowered by a factor of four.

Furthermore resetting may be done by applying a reduced row select voltage as the column voltage swing is reduced to a single constant voltage level of preferably 0V.

Further, it is preferred to keep a constant voltage level, e.g. the 0V on the column electrodes during the rest of the frame time while driving the display in the still-image mode to prevent any leakage of switched voltage through the switching circuit between inversions. This may be done with a reduced row non-select voltage. In practice the row electrode swing may be reduced from −15V/+15V for the select and non-select levels in the moving-image drive scheme to −10V/0V for the select and non-select levels respectively in the still-image drive scheme.

It may also be contemplated to keep a constant voltage level on the row electrodes that brings the switching circuits in a conducting state during the still image mode. This way the pixels are continuously charged to the corresponding constant voltage supplied on the column electrodes during the still image mode.

Direct Voltage Inversion

In another embodiment, inversion may be applied to a direct voltage electrode that has a connection to the driver per row of pixels. It is possible to selectively apply the semi bi-stable still image mode only to those rows that display a still image while other rows are still addressed with moving image content. The rows that are in the still image mode can be inverted all at the same time resulting in an extremely low power driving mode. This semi bi-stable mode can be applied to the examples shown in FIG. 6 and FIG. 7D.

It is desirable to reset the switched voltage after each inversion because of the abovementioned capacitive coupling effect. This only costs a minimal amount of power, as the reset can be done in one common line selection period (that can have a different length than a normal line selection period) for all rows that are in the semi bi-stable still image mode, where a reduced row select voltage can be used as the column voltage range is reduced to substantially only one level during the line selection period. When at the same time other rows are addressed with moving image content, the row non-select voltage should have the normal value used for the moving image mode to prevent leakage between the column electrodes and the switched voltage of the pixels in the still image mode.

While the still-image rows can be inverted simultaneously, in another embodiment, inversion may be done row-at-a-time for a group of pixels. In this case the inversion is done row-at-a-time for those rows that are in the semi bi-stable still image mode. Power reduction is not as high as in the previous two modes, but the advantage is that the change from regular row-at-a-time driving to semi bi-stable driving is seamless as both are addressed row-at-a-time. It is possible to selectively apply the semi bi-stable still image mode only to those rows that display a still image while other rows are still addressed with moving image content, where a reduced row select voltage can be used for the rows in the still image mode as the column voltage range is then reduced to only one DV level.

To reduce power consumption further it is also possible to first select all still image rows row-at-a-time, followed by the selection of the other rows. This reduces the power consumption as during selection of the still image rows the column voltage is at a substantially constant level.

The different still-image drive scheme variants described in the above may also be applied in combination to optimize the power saving characteristics of the display.

In particular, in illustrative embodiments (see, e.g., FIG. 7A) a drive scheme uses inversion via the common electrode, more particular, the still-image drive scheme involves periodically changing the still image voltage to invert the polarity of the supply voltage to prevent directional build-up of charges in the pixel cells while a direct terminal is charged with a direct voltage to the pixel and a still image voltage is addressed to the direct terminal of the still-image pixel cell with a switched voltage that is substantially zero.

The detailed drawings, specific examples and particular formulations given serve the purpose of illustration only. Other substitutions, modifications, changes, and omissions may be made in the design, operating conditions, and arrangement of the exemplary embodiments without departing from the scope of the invention as expressed in the appended claims.

What is claimed is:

1. A display apparatus comprising:

a plurality of electrofluidic chromatophore (EFC) pixel cells, each pixel cell comprising:

a fluid holder for holding a polar fluid and a non-polar fluid having differing display properties, the fluid holder comprising:

a reservoir with a geometry having a first visible area projected in the direction of a viewer onto the polar fluid, and a channel with a geometry having a second visible area projected in the direction of a viewer onto the polar fluid, the channel being connected to the reservoir so as to enable free movement of the polar fluid and non-polar fluid between the channel and the reservoir, at least part of a surface of the channel comprising a wetting property responsive to a supply voltage over the pixel cell, and at least two pixel cell terminals configured to provide the supply voltage to at least part of the surface of the channel comprising the wetting property;

a circuit board comprising:

a switching circuit connected to a switched terminal of the pixel cell for supplying a switched voltage to the pixel cells, a row electrode connected to the switching circuit, a column electrode connected to the switching circuit, and a driver configured to provide a drive signal charging the row electrode and the column electrode to activate the switching circuit to address the switched voltage to the pixel cell; and wherein the first visible area is smaller than the second visible area, and the display apparatus further comprises a display controller for controlling the driver, the display controller configured to execute the steps of:

determining still-image pixels displaying still-image content wherein the present cell display properties of the pixels remain substantially identical, providing still-image drive signals to the still-image pixels, addressing a still image voltage to the at least one other pixel cell terminal other than the switched terminal of the still-image pixels, resulting in a stable supply voltage that stabilizes the cell display properties of the still-image pixels so as to display still-image content in an energy efficient manner, and providing moving-image drive signals by the driver to apply to the moving-image pixels that do not remain substantially constant, wherein the moving-image drive signals address a direct voltage differing from the still image voltage, to the another one of the at least two pixel cell terminals, the display controller comprising a mode switch to switch between the moving-image drive signals and the still-image drive signals dependent on the image content.

2. The display apparatus according to claim 1, wherein the display controller is arranged to provide still-image drive signals generating a stable supply voltage in the absence of switching the switched terminal.

3. The display apparatus according to claim 1, wherein the display controller is arranged to provide still-image drive signals addressing a still image voltage such that a stable supply voltage is generated to the pixel cell while addressing a constant switched voltage to the switched terminal that is substantially lower than the stable supply voltage.

4. The display apparatus according to any one of claims 1, wherein the least one other pixel cell terminal other than the switched terminal is a common terminal connected to a common electrode, and wherein the still-image drive signals charge the common electrode to address the still image voltage to the common terminals of the pixels in the display.

5. The display apparatus according to claim 1, wherein the driver is configured to supply a direct voltage to the pixel via at least one direct electrode, wherein the at least one other pixel cell terminal other than the switched terminal is a direct terminal electrically connected to the at least one direct electrode, and wherein the still-image drive signals charge the at least one direct electrode to address the still image voltage to the direct terminal of the still-image pixel cell.

6. The display apparatus according to claim 5, wherein the still-image drive signals simultaneously charge a plurality of electrodes to simultaneously address the still image voltage in a plurality of still-image rows.

7. The display apparatus according to claim 1, wherein the still-image drive signals periodically change the still image voltage to invert the polarity of the supply voltage so as to obtain an average supply voltage that is essentially zero with no directional build-up of charges in the pixel cells.

8. The display apparatus according to claim 7, wherein the at least one other pixel cell terminal other than the switched terminal is a common terminal connected to a common electrode, wherein the still-image drive signals charge the common electrode to address the still image voltage to the common terminals of the pixels in the display, and wherein the polarity of the supply voltage is inverted by inverting the still image voltage applied to the common electrode.

9. The display apparatus according to claim 8, wherein the still-image drive signals periodically charge the row and/or column electrodes being coupled to the switching circuit to reset the switched voltage.

10. The display apparatus according to claim 7, wherein the driver is configured to supply a direct voltage to the pixel via at least one direct electrode, wherein the at least one other pixel cell terminal other than the switched terminal is a direct terminal being electrically connected to the at least one direct electrode, wherein the still-image drive signals charge the at least one direct electrode to address the still image voltage to the direct terminal of the still-image pixel cell, and wherein the polarity of the supply voltage is inverted by inverting the still image voltage applied to the direct electrode.

11. The display apparatus according to claim 1, wherein the cell display property is expressed as a transmission and/or reflection of the pixel cell for a predefined wavelength.

12. The display apparatus according to claim 1, wherein the polar fluid is conductive, and wherein the switched terminal is coupled to a contact electrode contacting the conductive polar fluid and the direct voltage terminal is coupled to a channel electrode.

13. The display apparatus according to claim 1, wherein the polar fluid is conductive, and wherein the switched terminal is coupled to a channel electrode and the direct voltage terminal is coupled to a contact electrode contacting the conductive polar fluid.

* * * * *